United States Patent [19]

McKean

[11] Patent Number: 4,470,329

[45] Date of Patent: Sep. 11, 1984

[54] AUTOMATIC STUD DRIVING TOOL

[75] Inventor: John A. McKean, Fairview, Pa.

[73] Assignee: Titan Tool Company, Fairview, Pa.

[21] Appl. No.: 360,821

[22] Filed: Mar. 24, 1982

Related U.S. Application Data

[63] Continuation-in-part of Ser. No. 265,706, May 21, 1981, abandoned.

[51] Int. Cl.[3] ..... B25B 19/00

[52] U.S. Cl. ..... 81/53.2

[58] Field of Search ..... 81/53.2

[56] References Cited

U.S. PATENT DOCUMENTS

| | | | |
|---|---|---|---|
| 603,825 | 5/1898 | Barber . | |
| 1,583,554 | 5/1926 | Hoover . | |
| 1,607,804 | 11/1926 | Snyder . | |
| 1,807,265 | 5/1931 | Walker . | |
| 1,817,049 | 8/1931 | Weil . | |
| 1,825,876 | 10/1931 | Leiter . | |
| 1,835,168 | 2/1929 | McKean . | |
| 1,968,058 | 7/1934 | Senkewitz . | |
| 2,069,527 | 2/1937 | Kirkland . | |
| 2,216,557 | 10/1940 | McKean . | |
| 2,251,491 | 8/1941 | Lozen . | |
| 2,257,089 | 9/1941 | Caminez . | |
| 2,492,307 | 12/1949 | McKean | 81/53.2 |
| 2,516,288 | 7/1950 | Bagoon | 81/53.2 |
| 2,531,456 | 11/1950 | McKean | 81/53.2 |
| 2,628,105 | 11/1950 | McKean . | |
| 2,737,232 | 3/1952 | McKean . | |
| 2,743,639 | 5/1956 | Lynch | 81/53.2 |
| 3,443,818 | 7/1967 | Fauth . | |
| 3,672,692 | 6/1972 | Fauth . | |
| 3,793,912 | 2/1974 | Bilz | 81/53.2 |

FOREIGN PATENT DOCUMENTS

| | | |
|---|---|---|
| 1334909 | 10/1973 | United Kingdom . |

*Primary Examiner*—James L. Jones, Jr.
*Attorney, Agent, or Firm*—Parkhurst & Oliff

[57] ABSTRACT

A stud driver for the insertion of studs into a workpiece. The stud driver automatically grasps the stud once the stud is inserted into the stud driver. Once the stud is inserted into the workpiece, the stud driver automatically releases the stud. The stud driver employs a set of jaws to grasp the stud. The jaws, which are biased open by a plunger means, are enclosed with a carriage. In the peripheral wall of the carriage, two sets of balls are held. The balls prevent the jaws from sliding out of the carriage and from rotating in the carriage. The carriage is driven by a driven head which is connected to the driving means. The carriage and driven head are held in an uncomplicated hollow cylinder which is the body. Grooves in the faces of the jaws cooperate with the balls and allow a limited amount of reciprocation of the jaws within the carriage. Movement of the carriage within the body is not essential, so that the body serves to hold the balls in the carriage and to provide structural support.

8 Claims, 5 Drawing Figures

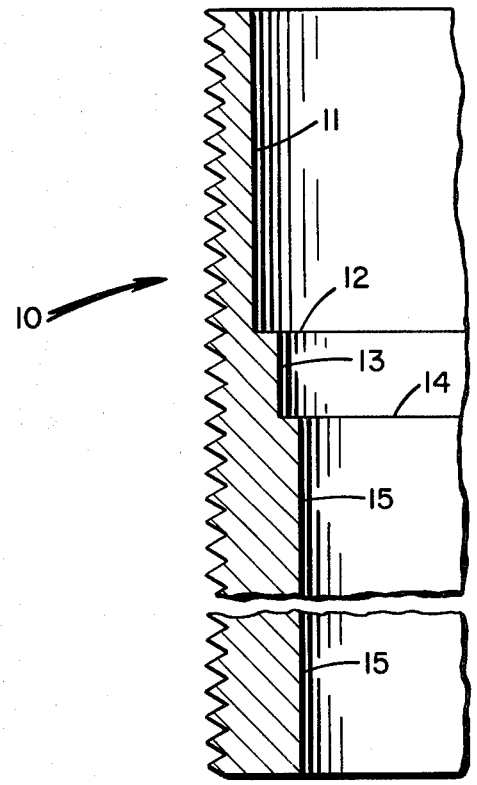
FIG. 4
FIG. 5
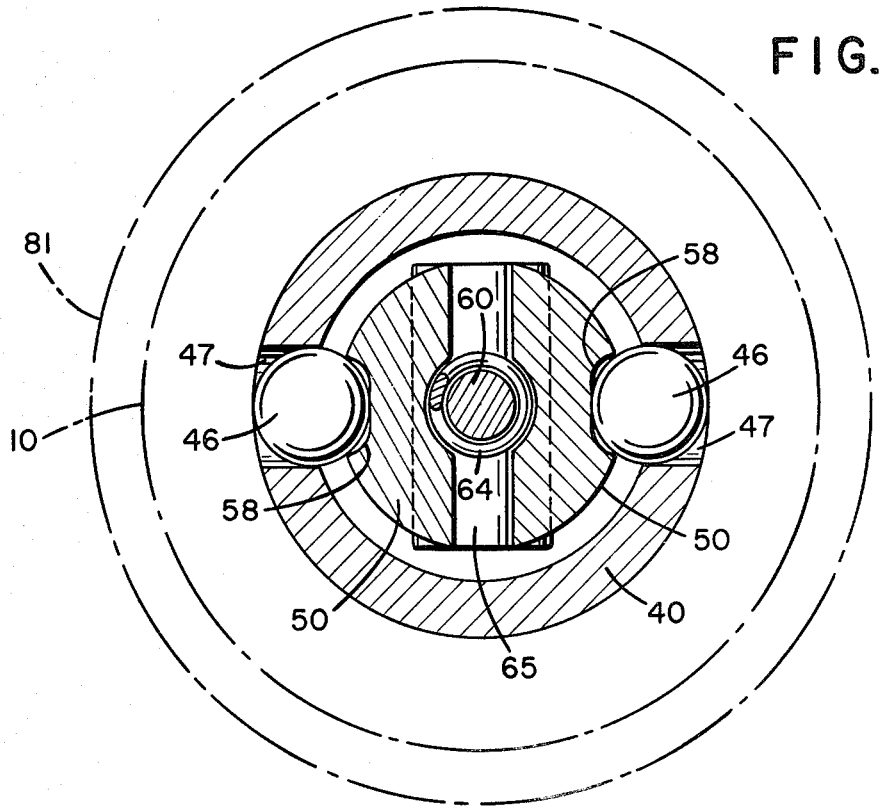

AUTOMATIC STUD DRIVING TOOL

CROSS-REFERENCE TO RELATED APPLICATIONS

This application is a continuation-in-part of Application Ser. No. 265,706, filed May 21, 1981, now abandoned, which shows an improvement to automatic stud drivers of the type described in U.S. patent application Ser. No. 179,444, filed Aug. 19, 1980, now abandoned.

BACKGROUND OF THE INVENTION

This invention relates to automatic stud drivers used for example in the automotive and furniture industries.

While automatic stud drivers of the type described in U.S. patent application Ser. No. 179,444 have worked extremely well, in some applications, it was discovered that the jaws would break or shear.

OBJECTS OF THE INVENTION

The principal objects of the present invention are to provide an automatic stud driver which can be easily and quickly assembled with a minimal number of tools, which is easier to manufacture than prior automatic stud setters, which is of smaller maximum outside diameter than prior automatic stud setters for use in work areas which larger prior automatic stud setters could not be utilized, and which will be less prone to breakage in use.

BRIEF DESCRIPTION OF THE DRAWINGS

FIG. 4 shows one half of a cross-sectional view of the body along the line C—C of FIG. 3; and FIG. 5 is a cross-sectional view along line B—B of FIG. 2.

DETAILED DESCRIPTION OF THE INVENTION

Figure 3:
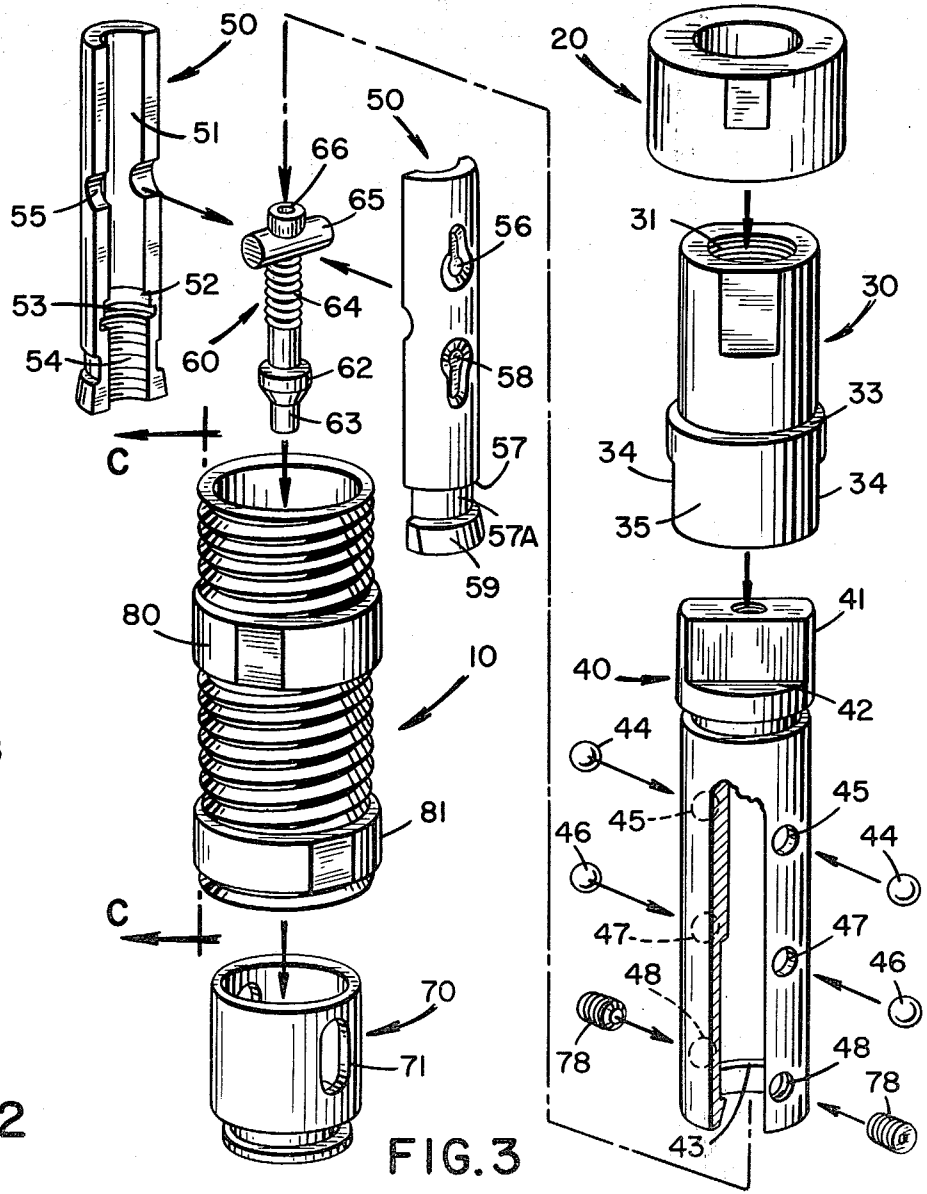
FIG. 3 is an exploded view of the stud driver.
Figure 2:
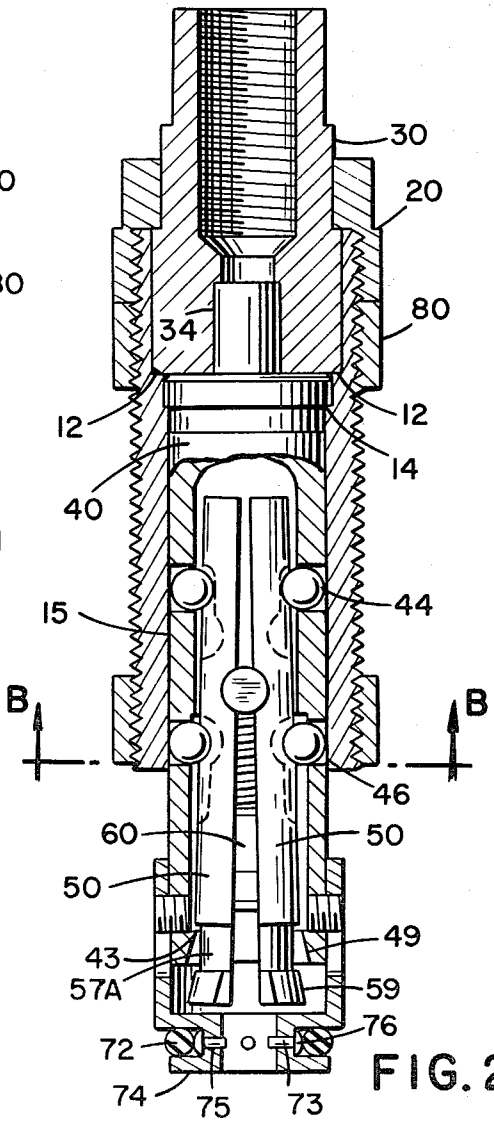
FIG. 2 is a partially cut away view along line A—A of FIG. 1, in which the plunging means, and the top of the carriage are not cut away.

The automatic stud driver according to the present invention comprises a body 10; a collar 20; a driven head 30; a carriage 40; two sets of balls in the carriage (two retaining balls 44 and two latching balls 46); a set of jaws 50; a plunger 60; and a stud pick-up and aligning means 70. As shown in FIG. 2, the assembled stud driver has three concentric cylinders, the body 10, the carriage 40 which is inside the body 10, and the driven head 30 also in the body 10.

The driven head 30 and the carriage 40 are secured inside of the body 10 by the collar 20, which screws onto the exterior threads of the body 10. The driven head 30 and the carriage 40 are prevented from sliding through body 10 by the head ledge 12 and the carriage ledge 14, respectively, both on the body 10 (FIG. 4).

In operation, the driven head 30 is attached to a driving means. The driving means supplies rotary and reciprocal motion to the stud driver. The driven head 30 is also coupled to the carriage 40 so as to transfer the power and motion of the driving means to the carriage 40.

The carriage 40 is the envelope for the assembly of jaws 50. The jaws 50 grip the stud by a grooved threaded section 54 whose threads match those of the studs. The jaws 50 are assembled about the plunger means 60 forming a cylindrical shape which is held together by the hollow inside surface of the carriage 40 (FIG. 2). A hole is formed by the grooved threaded section 54 in the bottom of the assembly of jaws 50. It is into this hole that the stud is inserted to be grasped by the jaws 50.

Figure 1:
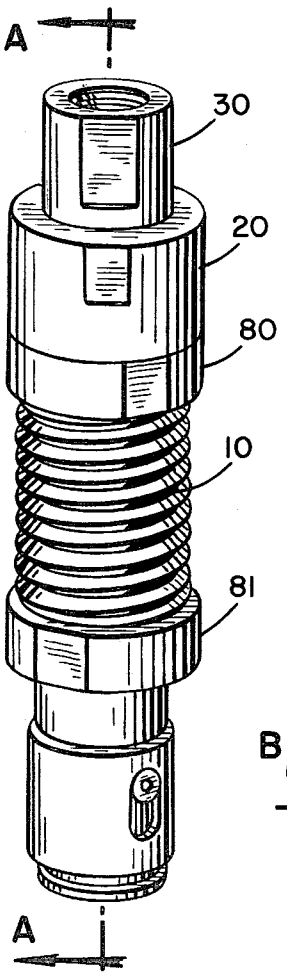
FIG. 1 is a perspective view of the stud driver.

To assemble the stud driver, the jaws 50 are held around the plunger means 60 and then inserted into the carriage 40. Then the retaining balls 44 and the latching balls 46 are placed into the retaining ball holes 45 and latching ball holes 47, respectively, in the carriage 40. The carriage 40 is slid into the body 10. The driven head 30 is slid into the body 10 on top of the carriage 40, such that the post 41 on the carriage 40 slides into the slot 34 in the driven head 30. The collar 20 is then slid over the driven head 30 and screwed onto the body 10, and the collet 80 (FIG. 1) is tightened up against the collar 20 to lock the collar 20 on the body 60 to complete the assembly of the stud driver. The collet 81 can be utilized to secure accessories, such as a dust cover or a trip gauge, to the tool.

Optionally, the stud pick-up and aligning means 70 may be slid onto the end of the carriage 40. The slots 71 in the stud pick-up and aligning means are aligned with the set screw holes 48 in the carriage 40, and the set screws 78 are inserted into the carriage 40.

To disassemble the stud driver, the reverse process in used. To remove the jaws 50 from the carriage 40, once the carriage 40 is out of the body 10, the jaws 50 have to be closed by inserting a stud into the jaws.

The assembly and disassembly of the stud driver requires only a stud, a hex and wrench for the set screws 78 if the optional stud pick-up and aligning means 70 is utilized, and a set of wrenches for the collar 20, collet 80 and optional collet 81, and driven head 30. The advantages of such a simple to assemble stud driver are enormous in saving time in maintaining the stud driver.

In the stud setter, the means to grip the stud are the jaws 50. On the inside planar surface of each jaw 50 is a semicircular groove 51 extending the length of the jaw. The lower section of the groove 51, the threaded section 54, is threaded to match the threads on the stud. Thus, when the jaws are closed onto the stud, the threaded section 54 of the jaws 50 can grip the stud without damaging any of the threads on the stud.

Fitted into the upper section of the groove 51 above the threaded section 54 is the plunger means 60. The plunger means 60 is held in the groove 51 of the jaws 50 by a pivot cylinder 65. The pivot cylinder 65 is slidably mounted on a threaded shaft 66 of the plunger means. The pivot cylinder 65 fits in the pivot grooves 55 of the jaws 50. The pivot grooves 55 are perpendicular to the lengthwise groove 51. The plunger means 60 biases the lower portion of the jaws 50 outwards to allow the jaws to slide over the stud. The jaws 50 are opened by an annulus 62 on the plunger means 60 which is biased towards the opening groove 53 of the groove 51 in the jaws and away from the closing groove 52. Since the closing groove 52 has a larger radius than does the annulus 62, the jaws can be closed while annulus 62 is in the closing groove 52 but since the annulus 62 is biased towards the opening groove 53, which has a smaller radius than annulus 62, the lower section of the jaws are spread apart as the annulus 62 is forced into the opening groove 53. Spreading out the jaws 50 disengages the threaded section 54 from the stud and releases the stud. The lower section of the annulus 62 is tapered inward so as to allow the annulus 62 to smoothly slide from the closing groove 52 to the opening groove 53.

The annulus 62 along with the entire lower half of the plunger means 60 is biased downward in the jaws 50 towards the opening groove 53 by a helical spring 64. The helical spring 64 pushes up against the pivot cylinder 65, which is slidably mounted on the threaded shaft 66. The pivot cylinder 65 is prevented from sliding off the threaded shaft 66 by the hex end head on the threaded shaft 66. The bottom 63 of the plunger means 60 extends into the threaded section 54 of the jaws. As the stud is inserted into the jaws 50, the end of the stud presses up against the bottom 63 of the plunger means 60 and, by overcoming the biasing force, forces the plunger means 60, including the annulus 62, upwards in the groove 51. The annulus 62 slides up into the closing groove 52 and allows the jaws to close onto the stud.

The outside diameter of the assembly of jaws 50 and plunger means 60 is substantially that of the inner surface of the hollow carriage to insure a snug fit of the jaws in the carriage. A snug fit between the jaws 50 and the carriage 40 is necessary to keep the latching balls 46 and retaining balls 44 in the carriage and pinned in the latching grooves 58 and retaining grooves 56 of the jaws. The inside diameter of the carriage is enlarged from just above the latching ball holes 45 down to the locking ledge 43, to give the jaws 50 room to spread out. Also, the diameter of the jaws assembly is reduced at the neck 57A, between the closing lips 59 and the locking ledge 57, to allow the jaws to spread even wider.

At the neck 57A, the jaws are thinner than at substantially any other portion of the jaw. Thus, at the neck 57A, the jaws are relatively weak. To preserve the strength of the jaws 50, the neck 57A is short relative to the jaw length. Further, the surface area of other cuts in the jaws, which also reduces the jaw thickness, is relatively small due in part to the shape and width of the cuts, such as the teardrop shaped retaining groove 56 and the thin latching groove 58. As a result of the few and small cuts in the jaws 50, the strength of the jaws has been preserved and the likelihood of their shearing or breaking has been greatly reduced.

The cylindrical assembly of the jaws 50 and the plunger means 60 is enclosed in the carriage 40. The carriage 40 is a hollow cylinder with a closed top end 42. Although the jaws and plunger assembly can easily be slid into the carriage, once inserted, the jaws 50 cannot accidentally slide out. The three means which prevent the jaws 50 from sliding out of the carriage are: the retaining balls 44 which ride in the peripheral wall of the carriage 40, the latching balls 46 which also ride in the peripheral wall of the carriage 40, and a locking groove 43 (FIG. 1) around the inside surface of the carriage. The locking ledge 43, which forms a circle perpendicular to the axis of the carriage 40 around the inside surface of the carriage 40, prevents the open jaws 50 from sliding out of the carriage 40 by acting as a stop for the locking ledge 57 on the jaws 50. When the carriage 40 is in the body 10, the retaining balls 44 prevent the jaws from sliding completely out of the body 10, regardless of whether the jaws 50 are closed or not.

The retaining balls 44 are held in the peripheral wall of the carriage 40 in the retaining ball holes 45. The retaining balls 44 have a diameter larger than the thickness of the peripheral wall of the carriage 40. Thus, when the carriage 40 is in the body 10 which brings the wall of the carriage 40 flush with inner surface 15 of the body 10, the retaining balls 44 protrude past the inside surface of the peripheral wall of the carriage 40 (FIG. 2). The jaws 50, which fit snugly in the carriage 40, compete for space inside the carriage with the retaining balls 44. The retaining balls 44 are forced into the retaining slots 56. The jaws assembly is not thin enough to fit between the protruding retaining balls 44 without the retaining balls 44 riding in the diametrically opposed retaining grooves 56. The retaining grooves 56 are long enough to allow the jaws 50 a limited range of sliding movement up and down within the cylindrical casing of carriage 40. Within this range, the jaws 50 can slide out of the carriage 40 until the ledge 57 nearly engages with the locking ledge 43 of the carriage 40 and the jaws 50 can slide into the carriage 40 until the bottom of the jaws 50 are approximately flush with the bottom of the carriage 40. The retaining grooves 56 have a teardrop shape; the wide bottom of the teardrop faces towards the jaws' closing lips 59. Although it is not preferred, a further narrow and shallow end could be provided below the wide and deep portion.

While the jaws 50 are disengaged from any stud and rest partially out of the carriage, the retaining balls 44 ride in the narrow top of the retaining grooves 56 to align the jaws' latching grooves 58 with the latching balls 46. But when the jaws 50 engage a stud and thus the jaws are up in the carriage 40, the retaining balls 44 ride in the wide bottom of the retaining grooves 56 which prevents the retaining balls 44 from binding against the side of the retaining grooves 56.

The jaws 50 are also held within the carriage by the latching balls 46. The latching balls 46 are held in the peripheral wall of the carriage 40 in the latching ball holes 47. As with the retaining balls 44, the latching balls 46 have a diameter larger than the thickness of the peripheral wall of the carriage 40. Thus, the latching balls 46 are forced to extend past the inner surface of the peripheral wall of the carriage 40.

The latching balls 46 protrude past the carriage wall into the latching grooves 58. Without the latching grooves 58 the cylindrical jaws assembly would be too thick to allow the latching balls 46 to ride in the carriage 40 between the body 10 and the jaws 50. Each latching groove 58 is cut into the periphery of the jaws 50 parallel to the lengthwise groove 51. The latching grooves 58 are inverted teardrop in shape to make the transition between the retaining grooves 56 alignment function to the latching grooves 58 latching function smooth. The latching grooves 58 are long enough to allow the latching balls 46 to ride in the slot 58 while the jaws 50 slide up and down in the carriage 40. The jaws 50, however, cannot slide completely out of the carriage while the latching balls 46 ride in the slots 58.

All the means which prevent the jaws 50 from sliding completely out of the carriage 40, allow the jaws 50 a limited amount of sliding within the carriage 40. That limited amount of sliding of the jaws 50 is the means by which the jaws are closed and allowed to open. When the jaws have slid partially out of the carriage, as in FIG. 2, the jaws 50 are biased open by the plunger means 60. When a stud is inserted into the jaws 50, the stud pushes the jaws 50 up into the carriage 40 which brings the closing lip 59 on the jaws 50 into engagement with the tapered surface 49 on the carriage 40. Engagement of the closing lips 59 and the tapered surface 49 causes the lower half of the jaws 60 to come closer and closer together as the jaws 50 are slid further and further up into the carriage 40 until finally the jaws close firmly onto the stud preventing the closing lips 59 from sliding any further up against tapered surface 49. Once this happens, the jaws 50 are fully closed onto the stud. The tapered surface is the preferred form of a closing projection which cooperates with the jaws.

The latching balls 46 bind against the side of the latching grooves 58 to prevent rotation of the jaws in the carriage. Since the latching grooves 58 are thinner than the bottom of the retaining grooves 56, only the latching balls 46, and not the retaining balls 44, bind against the jaws. Thus, when the stud is being spun into the workpiece, the stud cannot force the jaws 50 to spin around in the carriage 40.

Power and motion is imparted to the stud driver through the driven head 30. The driven head 30 is rotatably held into the body 10 by the collar 20 by engaging with the lip 33 on the driven head 30. Cut through the bottom of the driven head 30 is a slot 34 perpendicular to the axis of the driven head 30. This slot 34 slidably but nonrotatably engages with the post 41 on the top of the carriage 40. The top end 31 of the driven head 30 is attached to some driving means, such as a drill press, which imparts reciprocal and rotary motion to the stud driver.

The collar 20 holds the driven head 30 in the body 10. The collar 20 screws on to the top of the body 10. The collar 20 engages wtih lip 33 and bearing surface 35 on the driven head 30. The collar 20 holds the driven head 30 coaxial to the body by the engagement of the bearing surface 35 and a similar bearing surface on the inside of the collar.

Planar surfaces 32 have been cut out of the upper cylindrical surface of the driven head 30 so a wrench can be used to tighten the driven head 30 onto the driving means. A similar planar surface has been cut out of the outer cylindrical surface of the collar 20 to also provide a grip for a wrench to tighten the collar 20 onto the body 10. Collet 80 has a planar surface for a wrench and is tightened up against the collar 20 as a locking mechanism to prevent the collar 20 from being shaken loose during operation of the stud driver.

The optional stud pick-up and aligning means 70 picks up and holds the stud until the stud is to be inserted into the jaws. The stud pick-up and aligning means 70 initially aligns the stud coaxial to the jaws 50, prior to its insertion into the jaws 50.

The bottom of the stud pick-up and aligning means 70 has an inverted table top section 74 having four holes 75 symmetrically disposed about its side, each of which holds one of a plurality of pins 73. The pins 73 each have a head 76 which prevents them from sliding through the holes 75. The pins 73 are biased inwards towards the axis of stud pick-up and aligning means 70 by a resilient O-ring 72. The pins 73 engage the end of the stud when the stud in inserted into the stud driver and position the stud towards the center of the jaws 50. The pins 73 do not firmly grasp the stud and thus allow the stud to slide past and rotate in the pins 73. The stud pick-up and aligning means 70 is held onto the carriage 40 by two diametrically opposed set screws 78 which are enclosed by corresponding slots 71 in the peripheral wall of the stud pick-up and aligning means 70. The set screws 78 are set in set holes 48 in the carriage 40 and protrude out from the peripheral wall of the carriage 40. The set screws 78 are inserted in the carriage 40 after the stud pick-up and aligning means 70 has been slid onto the end of the carriage 40. The slot 71 and set screw arrangement permits the stud pick-up and aligning means 70 to slide up and down a limited distance relative to the carriage 40.

In operation, the assembled stud driver is attached by the driven head 30 to the driving means. In the beginning of the sequence (as shown in FIG. 2), the jaws 50 are open and partially out of the carriage 40. When the stud driver has the optional stud pick-up and aligning means 70, the stud is inserted into the stud driver, by first passing through the stud pick-up and aligning means 70 which picks up the stud and holds the stud until the stud is to be inserted into the jaws. Usually the stud is held in the stud pick-up and aligning means 70 until the stud is brought into contact with the threaded stud hole, formed by the threaded sections 54, at which time the stud is pushed up into the jaws as the stud pick-up and aligning means 70 aligns the stud coaxial to the open jaws 50. As the stud is further inserted into the stud driver, the end of the stud abuts the bottom 63 of the plunger means 60. Once the stud overcomes the biasing force of the helical spring 64, the stud forces the annulus 62 to slide up into the jaws 50 from the opening groove 63 of the jaws into the closing groove 52. Once the annulus 62 of the plunger means 60 abuts up against the top of the opening groove 52 of the jaws 50, the upward movement of the stud forces the plunger means and jaws assembly up into the carriage. As the jaws 50 slide up into the carriage 40, the closing lips 59 of the jaws slide against the tapered inner surface 49 of the carriage 40 and force the threaded section 54 of the jaws 50 to firmly close onto the stud.

In stud drivers of the type described in U.S. patent application Ser. No. 179,444, a camming step 16 was required to allow the latching balls 46 to come out away from the jaws 50 during the opening of the jaws 50. In the present invention, a camming step 16 is not necessary, since the latching balls can ride in the latching grooves 58 as the jaws open and close. The elimination of the need for camming surface 16 eliminates the need for the carriage 40 to ride up and down within the body 10. The length of the latching grooves is substantially equal to the length of the retaining grooves. This length defines the distance over which the jaws reciprocate.

Since it is not essential for the carriage to reciprocate within the body, the body is basically useful for structural integrity and for retaining the balls 44 and 46 in the holes in the carriage. Thus, in low stress applications, the body 10 could be completely eliminated and replaced with a thin sleeve or band around the outside of the carriage for holding the balls in place. Similarly, since reciprocation of the carriage is not necessary, the driven head 30 could be made unitary with the carriage. Thus, the head ledge in the carriage would be unnecessary.

When the stud driver first starts rotating the stud down into the workpiece, the stud resists being screwed into the workpiece and rotates in the threaded section 54 of the jaws 50. However, as the stud rotates in the threaded section 54, it screws further and further up into the jaws 50 until it finally abuts the bottom 63 of the plunger means 60. The plunger bottom 63 is prevented from going any further up into the jaws 50 by the annulus 62, which is abutted up against the top of the opening groove 52. Once the stud is up against the bottom 63, the stud is prevented from rotating any further up into the jaws 50. At that point, the stud will try to rotate the jaws 50 within the cylinder 40 but the latching balls 46 abut against the side of the latching grooves 58 to prevent any rotation of the jaws within the carriage.

Once the stud is stopped from rotating in the jaws 50 by the plunger bottom 63 and the jaws 50 are stopped from rot ..ing in the carriage 40 by the latching balls 46 binding against the latching grooves 58, the stud is forced to rotate down into the workpiece.

After the stud is fully inserted into the workpiece, the stud driver, which is still grasping the stud, is pulled up away from the stud. The jaws 50 are pulled by the stud down out of the carriage 40 until the closing lips 59 are disengaged from the tapered surface 59 of the carriage 40, which allows the plunger means 60 to bias open the jaws 50 and disengage the stud from the stud driver, completing the operation of inserting the stud into the workpiece.

Provision could be made for reciprocating movement of the carriage within the body if desired. For example, if it is desired to secure a trip gauge to collet 81 so that a stud is driven to an exact height, movement of the carriage within the body could be advantageous. Reciprocating movement of the carriage with respect to the head 30 would also be desirable in this situation. The provision of such movement of the carriage would also allow for a camming step if as described above, but as also indicated above, this camming is not necessary. Movement could be provided for by lengthening the body 10 and lowering the carriage ledge with respect to the head ledge.

What is claimed is:

1. A stud driving device, comprising:

a rotatably driven carriage having a peripheral wall;

at least one retaining ball held in said peripheral wall and protruding from the inner surface of said peripheral wall;

at least one latching ball held in said peripheral wall and protruding from the inner surface of said peripheral wall;

means for holding said at least one retaining ball and said at least one latching ball in the peripheral wall, the relative axial position between said means for holding and said carriage remaining constant, said means for holding having a constant inner diameter between said at least one retaining ball and said at least one latching ball;

a closing contour extending inwardly from the inner surface of said peripheral wall near the bottom edge of said carriage;

a plurality of stud-gripping jaws held within said carriage, said jaws forming a substantially cylindrical assembly, and reciprocating in and partially out of said carriage, said reciprocation being relative to said at least one retaining ball and said at least one latching ball, said jaws being open when extending partially out of said carriage and closed when in said carriage, said jaws assembly comprising:

a closing lip on each of said jaws which cooperates with said closing contour;

means for holding a stud inside of said jaws assembly;

at least one longitudinally extending retaining groove formed on the face of one of said jaws for cooperating with said at least one retaining ball, said at least one retaining groove having a relatively narrow and shallow upper end and a relatively wide and deep lower portion;

at least one longitudinally extending latching groove formed on the face of one of said jaws for cooperating with said latching ball, said at least one latching groove having a relatively wide and deep upper end and a relatively narrow and shallow lower end, said at least one retaining ball being disposed in the wide portion of said at least one retaining groove and said at least one latching ball being disposed in the narrow end of said at least one latching groove when said jaws are closed, and said at least one retaining ball being disposed in the narrow end of said at least one retaining groove and said at least one latching ball being disposed in the wide end of said at least one latching groove when said jaws are open, said at least one retaining ball and said at least one latching ball contacting said constant inner diameter of said means for holding when said jaws are open and closed.

2. A stud driving device as claimed in claim 1, wherein said means for holding is a body within which said carriage is located.

3. A stud driving device as claimed in claim 1 wherein said latching and retaining grooves are of a tear drop shape.

4. A stud driving device as claimed in claim 1, wherein two diametrically opposed retaining balls are held in said peripheral wall, two diametrically opposed latching balls are held in said peripheral wall, two longitudinally extending latching grooves are on the face of the jaws assembly, and two longitudinally extending retaining grooves are on the face of said jaws assembly, said latching and retaining grooves being of substantially equal length, the length of said grooves determining the distance of reciprocation of said jaws.

5. An automatic stud driving tool comprising:

a carriage having a longitudinal axis, the carriage provided with a cavity extending therethrough along said axis;

a pair of opposed jaws provided partially within said cavity and capable of sliding simultaneously as a unit along the axis of said carriage, means for assuring that the jaws are capable of moving about a pivot axis and with respect to said carriage to at least two positions relative to each other, an open and a closed position;

the pair of jaws being provided with gripping means for gripping a stud in a non-rotatable manner when said jaws are in said closed position, and for releasing said stud when said jaws are in said open position;

preventing means for positively preventing the jaws from moving from the open position to the closed position unless a stud is engaged with said gripping means;

holding means for preventing the removal of the jaws from the carriage when said jaws are in said open position, said holding means comprising selectively interengaging surfaces integrally formed on the surface said jaws and on the surface of said cavity, said surfaces being located between the gripping means and the pivot axis such that when the jaws assume their open position the interengaging surfaces will abut and prevent removal of said jaws, but when said jaws assume their closed position the interengaging surfaces do not abut and the surfaces can move axially past each other so that the jaws can be removed from said carriage; and means to rotate the carriage to thereby rotate the jaws, to in turn rotate the stud into a work piece.

6. An automatic stud driving tool as in claim 5, wherein the gripping means are located on the interior face of the jaws at the axial end thereof furthest from the carriage, the selectively engaging surface on the jaws is located on the exterior surface thereof at the substantially same axial level as the gripping means and, the selectively interengaging surface on the cavity is located at the substantially same axial level as the gripping means.

7. An automatic stud driving tool as in claim 5, wherein a body surrounds the carriage, the body and carriage are rotatable relative to each other, and the carriage and body do not move axially with respect to each other.

8. A carriage assembly for an automatic stud driving tool, comprising:

a carriage having a longitudinal axis, said carriage having an interior surface defining a cavity extending therethrough along said axis;

a pair of opposed jaws provided partially within said cavity and capable of sliding simultaneously as a unit along the axis of said carriage, said opposed jaws having gripping surfaces at a first end thereof;

pivot means for assuring that said opposed jaws are capable of moving about a pivot axis which is transverse to the longitudinal axis of said carriage;

actuating means for moving the jaws from an open position to a closed position upon insertion of a stud between said opposed jaws; and holding means for preventing removal of the opposed jaws from the carriage when said jaws are in said open position, said holding means comprising selectively interengaging surfaces integrally formed on a surface of the jaws and on the interior surface of said carriage, said interengaging surfaces being located along said longitudinal axis between the pivot axis and the first end of said opposed jaws such that when the opposed jaws assume their open position the interengaging surfaces will abut and prevent removal of said opposed jaws, but when said opposed jaws assume their closed position the interengaging surfaces define a clearance therebetween;

whereby the jaws are retained within said carriage solely by said interengaging surfaces during assembly of the automatic stud driving tool.

* * * * *